United States Patent [19]

Reynolds

[11] Patent Number: 4,823,474

[45] Date of Patent: Apr. 25, 1989

[54] BOW SIGHT

[76] Inventor: Loyd I. Reynolds, Rt. 1, Box 480, Catoosa, Okla. 74015

[21] Appl. No.: 88,595

[22] Filed: Aug. 21, 1987

Related U.S. Application Data

[63] Continuation-in-part of Ser. No. 919,039, Oct. 15, 1986, abandoned.

[51] Int. Cl.[4] ..... F41G 1/00

[52] U.S. Cl. ..... 33/265; 124/87

[58] Field of Search ..... 33/265; 124/87, 88, 124/24 R

[56] References Cited

U.S. PATENT DOCUMENTS

| | | | |
|---|---|---|---|
| 2,893,124 | 7/1959 | Sundquist | 33/265 |
| 2,982,026 | 5/1961 | Peterson | 33/265 |
| 3,455,027 | 7/1969 | Perkins | 33/265 |
| 3,475,820 | 11/1969 | Kernan | 33/265 |
| 3,487,548 | 1/1970 | Frydenlund | 33/265 |
| 3,670,422 | 6/1972 | Stebbins et al. | 33/265 |
| 3,822,479 | 7/1974 | Kowalski | 33/265 |
| 3,871,105 | 3/1975 | Brougham | 33/265 |
| 4,020,560 | 5/1977 | Heck | 33/265 |
| 4,136,461 | 1/1979 | Gasser | 33/265 |
| 4,178,693 | 12/1979 | Smith | 33/265 |
| 4,462,163 | 7/1984 | Tentler et al. | 33/265 |
| 4,494,313 | 1/1985 | Scott | 33/265 |
| 4,497,116 | 2/1985 | Hawkins | 33/265 |
| 4,535,747 | 8/1985 | Kudlacek | 33/265 |
| 4,543,728 | 10/1985 | Kowalski | 33/265 |
| 4,584,777 | 4/1986 | Saunders | 33/265 |
| 4,669,196 | 6/1987 | Kersey | 33/265 |

*Primary Examiner*—William A. Cuchlinski, Jr.
*Assistant Examiner*—Patrick R. Scanlon

[57] ABSTRACT

A bow sight is disclosed that provides vertical adjustability by movement of a finger of an archer's hand that is holding the bow in a shooting position. The bow sight comprises an elongated housing mountable adjacent a front edge of a bow with an elongated vertical screw member held rotatably by the housing. A sight carriage, with a horizontal sighting element extending therefrom, moves with the screw member as the screw member rotates in response to rotation of a knob at the lower end of the screw member.

12 Claims, 5 Drawing Sheets

BOW SIGHT

CONTINUING DATA

This application is a continuation-in-part of copending U.S. Pat. Application Ser. No. 919,039 filed Oct. 15, 1986 and now abandoned.

BACKGROUND OF THE INVENTION

1. Field of the Invention

My invention relates to bow sights for use by archers. More particularly, my invention relates to bow sights which can be easily mounted upon commercially available bows by archers who wish to increase the accuracy of their archery. Still more particularly, my invention relates to bow sights which are mountable upon bows and which are adjustable to accommodate various conditions of the archery.

2. Setting of the Invention

Bows are customarily sold without bow sights attached thereto. Rather, the archer, if he wishes, selects the bow sight he prefers according to what he believes will best fulfill the needs of his particular use, ability, and equipment from the many kinds of sights presently available.

Thus, an archer might begin his career by using a bow which does not have a bow sight and essentially rely upon an instinctive feeling for the proper range, timing, windage, and other factors. As he becomes more adept, he might feel that he has reached his ultimate capability of accuracy without a bow sight and consequently choose a bow sight attachment to further improve his accuracy.

With experience, the archer must consider many factors in his judgment of the proper aiming of an arrow. Some of these factors are: innate qualities of the bow, such as the flexibility of the bow in response to atmospheric conditions and the tension of the bow string; the type of arrow he is using, as to weight, structure, etc.; and the wind conditions at the shooting area.

Theoretically, an archer engaged in archery competition has more time to sight in his target than an archer who is hunting game. The hunter is often surprised by the sudden appearance of the game and forced to make a fast aim with the bow sight.

Thus, as shown by many patents, a bow sight designed for the archery range might be much more elaborate than a bow sight designed for the hunter where the primary consideration is the need to align the bow sight quickly.

Several different types of bow sights have been developed, with the most interesting type being bow sights having adjustability of the sight. Bow sights of this type are shown in U.S. Pat. Nos. 4,543,728, and 4,020,560. Nowhere in any of these patents is there any disclosure or suggestion of a bow sight with vertical adjustability while the archer is holding the bow in a shooting position. Specifically, there is no disclosure or suggestion of a bow sight that can be adjusted by rotation of the archer's finger while holding the bow in a shooting position.

Other bow sights that are adjusted by the movement of the archer's finger are shown in U.S. Pats. Nos. 4,497,116, 4,178,693 and 4,555,856. Nowhere in any of these patents is there any disclosure or suggestion of a bow sight having its sight carriage on a screw or helix gear moved vertically by the rotation of the archer's finger on the hand that is actually holding the bow in a shooting position.

Problems encountered in the past with the above types of bow sights are that the bow sights are either not very precise (not accurate in movement or adjustment), are not rugged enough for use in hunting, or are not designed specifically to be operated while the bow is being held in a shooting position.

There is a need for a bow sight that is precise, rugged and most importantly, able to be adjusted by movement of an archer's finger on the hand actually holding the bow in a shooting position.

SUMMARY OF THE INVENTION

The present invention has been contemplated to overcome the foregoing problems and meet the above described needs. Specifically, the present invention is a bow sight providing quick vertical adjustability of movement of a finger of an archer's hand that is holding the bow in a shooting position. The bow sight includes an elongated sight housing which is mounted to the bow above a hand grip portion thereof and in a position such that the bow sight will be adjusted vertically by movement of a finger of the archer's hand that is holding the bow in a shooting position. Upper and lower support members extend from an upper and a lower portion of the sight housing and an elongated screw member is rotatably mounted there between. A lower end of the screw member extends downwardly and a knob is mounted thereto so that the screw member can be rotated by a finger of the archer's hand that is holding the bow in a shooting position. A sight carriage is mounted to the screw member including a pin or similar device to vertically move the sight carriage as the screw member rotates. A horizontal sighting element extends from the sight carriage of the type that can be adjusted to compensate for windage.

The concepts clearly evident in the patents cited above are first of all, those bow sights described above which are intended strictly for tournament competition are very obviously designed to attempt to gain accuracy for the archer at the sacrifice of being able to aim quickly and easily at the target. The hunter must have a bow sight of simple design with a fast sighting adjustment action.

My bow sight is of simple design and provides for fast and convenient sighting adjustment. The hunter can adjust the sighting elements of my bow sight vertically at any time during use, for example, prior to drawing back of the bow string, while he is drawing back on the bow string and preparing to aim at the game, or most importantly, while he has the bow string at a fully drawn position and sighting the game while the game is moving.

I have designed my bow sight to have a knob attached to a screw member upon which the sighting element is positioned. I have positioned the knob beneath a lower flange member of a housing securing the bow sight to the bow. Thus, in this position, the knob is within easy reach of a finger of the hand gripping the bow. The hunter then, by extending his index finger, may easily reach the knob to rotate the knob in either direction and consequently raise or lower the sighting element. The hunter can perform this motion while he is firmly gripping the bow with his bow hand, and as I mentioned above, even while he is drawing back on the bow string and zeroing in on his quarry. During this entire action, because of the design of my bow sight, the hunter has control of the bow sight and is able to keep his eye on the sight and on the game. If he needs to determine the present range setting, as the game is moving, he need not actually move his eye because an index pointer indicating the range is in the same horizontal plane as the sighting element, and is a part thereof.

The smooth, easy action of the sighting carriage in cooperation with the screw member permits the hunter to make a fine adjustment of the sighting element at any point within the limitations of the particular bow sight being used. The limitations of the bow sight being used, that is, the adjustability of the bow sight should correspond suitably with the limitations of the bow which are in turn determined by the type, size, and construction of the bow.

In preparing to use a bow equipped with my bow sight, a hunter can easily and quickly calibrate the bow sight with regard to current conditions at the hunting site, such as the innate qualities of the bow, the innate qualities of the arrows being used, and the weather conditions.

The experienced hunter is capable of judging distance very accurately as he is performing the calibration. He also knows very well what the trajectory of his particular arrow will be, and therefore what that trajectory will be in combination with his particular bow. Then, in using this knowledge in conjunction with a few practice shots, he can easily calibrate the bow sight, in the manner I shall describe later, and be ready for his accurate hunting shots.

After the hunter has the bow sight properly calibrated and is prepared to shoot the game, he can readily zero in on the game and follow the movement of the game without distraction of any multiple sighting elements, such as multiple beads or windows, or further distraction by being required to move his eyes inordinately to observe the range setting.

Further features of my bow sight are the capability of the bow sight to be easily converted from a mounting position for a right-handed archer to a mounting position for a left-handed archer, along with the adaptability of my bow sight for use as a means for estimating a distance.

I have designed my bow sight so that certain embodiments of it can be easily converted from a right-handed model to a left-handed model, and conversely, by simple rearrangement of one or more components; and certain other embodiments can be easily converted similarly by replacement of a bracket securing the bow sight to a bow, as from a right-hand type bracket to a left-hand type bracket with consequent rearrangement of one or more components. With a bracket-mounted model I would have alternate bracket members available to the archer.

As mentioned above, an experienced hunter is capable of estimating distance very accurately as he is performing a calibration adjustment with the bow. For example, in performing calibration with my bow, his procedure might be to choose and aim at a point or object which he estimated, or has measured, to be at twenty yards from his position. He will then shoot a few arrows at that point, after each of which he will adjust the sight so that the twenty yard reading on his sight coincides with the point of impact of the arrow. Then, for use of the bow sight as a range finder, he will be able to coordinate the range setting of the bow sight with the landing point of the arrow or each of a succession of arrows as he adjusts the aim for each arrow.

DESCRIPTION OF THE PREFERRED EMBODIMENTS

Figure 1:
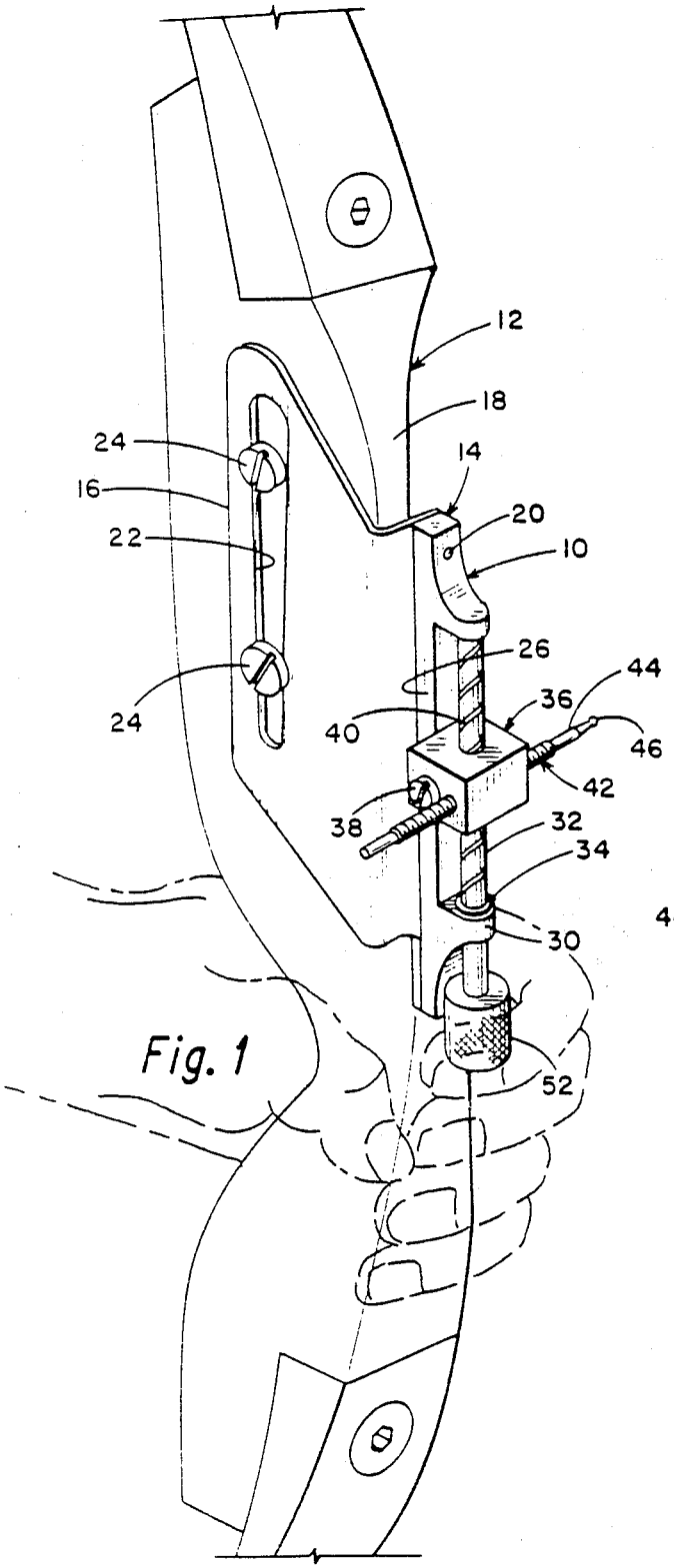
FIG. 1 is a perspective view of a bow sight according to my invention showing a portion of a typical bow with the bow sight mounted in proper position.
Figure 5:
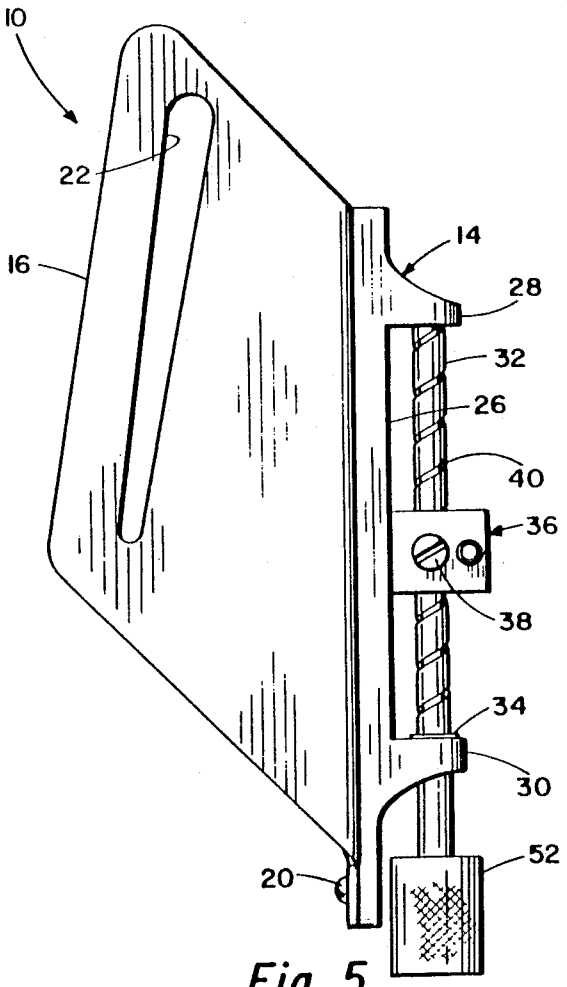
FIG. 5 is a side elevational view of the bow sight shown in FIG. 1 showing the opposite side to that shown in FIG. 3.
Figure 3:
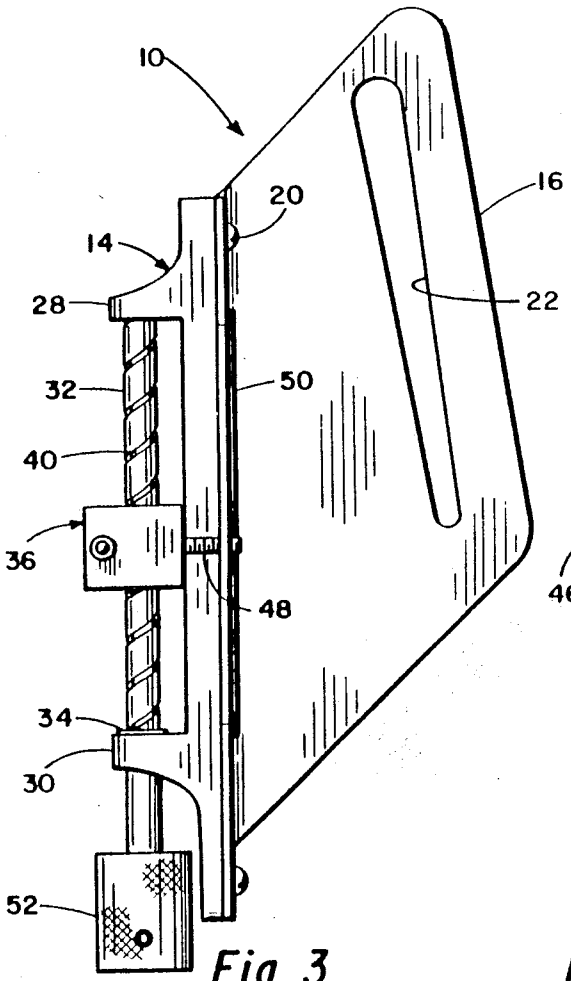
FIG. 3 is a side elevational view of the bow sight shown in FIG. 1.
Figure 6:
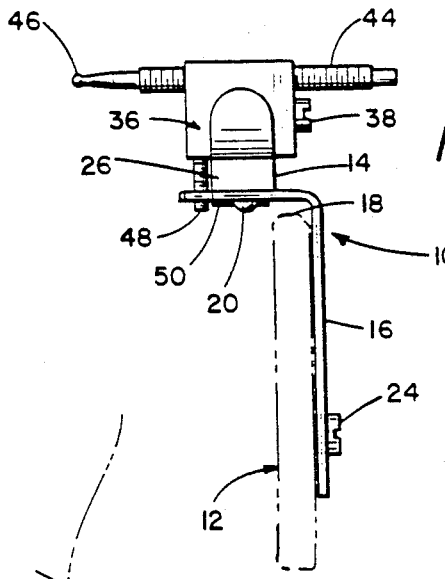
FIG. 6 is a top view of the bow sight shown in FIG. 1 showing a portion of the bow in partial phantom.

FIG. 1 is a perspective view of a bow sight 10, mounted in position on a recurve or compound bow 12, which is shown in fragmentary form. The bow sight 10 includes an elongated housing 14, secured to a mounting bracket 16. Bow sight 10 is held in position on the front side of my bows, i.e., the target side 18 of bow 12 (the side of the bow which is nearest the target when the archer is holding the bow in ready shooting position). The rear of the bow, being opposite the target side 18, I prefer to refer to as the string side, which is the side of the bow nearest the string. The housing 14 is secured to the mounting bracket 16 by screws or small bolts 20 at the upper and lower ends of housing 14. Bracket 16 includes a slot 22 through which bolts 24 pass with the threadable portions cooperating with similar threads (now shown) in the side of bow 12. Slot 22 is longer than the distance between the two bolts 24, and is tapered, being more narrow at the bottom than at the top, as shown in FIGS. 1, 3, and 5, in order to provide a vertical adjustment and a slight radial adjustment, with the heads of bolts 24 being large enough to compensate for any slight radial movement of bracket 16 as may be readily understood from FIG. 1.

The purpose for the front-to-back, up-to-down and radial adjustability of the bracket 16 is to permit the placement of the bow sight in a position that it can be easily adjusted by the rotational movement of a finger on the archer's hand that is holding the bow in a shooting position. Specifically, the bow sight should be mounted above the hand grip portion of the bow and the adjustment mechanism, as described in detail later, is placed at or adjacent the center line of the bow so the archer's index finger can easily adjust the bow sight.

Elongated housing 14 comprises a base portion 26 from which an upper support or flange member 28 and a lower support or flange member 30 extend. Support members 28 and 30 can be either integral portions of housing 14 or can be separate components secured thereto. Upper flange 28 and lower flange 30 receive rotatably between them an elongated helical screw member 32. Upper flange member 28 can include a bearing portion therein (not shown) and lower flange member 30 can include a bearing therein (not shown) which cooperate to hold in position the screw member 32 with which a lock ring 34 snaps into position on a groove on screw member 32 to assist in holding screw member 32 in smooth, precise position.

I have designed a sight carriage 36, generally, to be positionable upon screw member 32 by having a bore slightly larger than screw member 32 so that sight carriage 36 can move smoothlyand with precision along screw member 32. I have provided a guide member 38, generally, mountable in sight carriage 36 in a manner that the internal end is adaptable to cooperate with and move within a helical groove 40 of screw member 32 and to be adjustable as may be readily seen from FIGS. 1 and 5, most importantly to permit accurate sighting and range adjustment of sight carriage 36, and also to permit the degree of frictionable slidability along screw member 32 as the archer desires. Guide member 38 may be provided in several variations. For example, guide member 38 can be a unitary component threadably mounted in sight carriage 36, such as a threaded pin. Or, guide member 38 can comprise two or more components such as a pin adjustably to move within groove 40 and with a separate threaded member adjustably mounted in sight carriage 36 having an external slotted portion as described in FIG. 1. Or, another modification is to comprise a pin removably positioned internally of sight carriage 36 having one end slidable within groove 40.

The pitch of the helical groove 40 in the screw member 32 is important because easy, precise, and quick adjustments are needed. If the pitch is too high, the mechanical force needed to raise or lower the sight carriage increases to a point that the sight is difficult to adjust by rotational movement of the archer's finger. If the pitch is too low, many turns of the screw member 32 would be needed to make even the slightest adjustment. In one embodiment of my invention, the pitch is chosen so for that the average archer, one rotation or stroke of the finger cooperating with the screw member 32, as will be described below, will move the target distance about 8 to 10 yards.

I have further designed the sighting carriage 36 to include a simple, easily manipulable and adjustable sighting element 42, generally, which includes a sight rod 44 threadably mounted in the sight carriage 36. Sight rod 44 further includes an aiming component at the end thereof, preferably, as I have shown in the figures, comprising a sight bead 46. The inward or outward threadability of sight rod 44 permits quick and easy windage adjustment of the sight rod.

Figure 2:
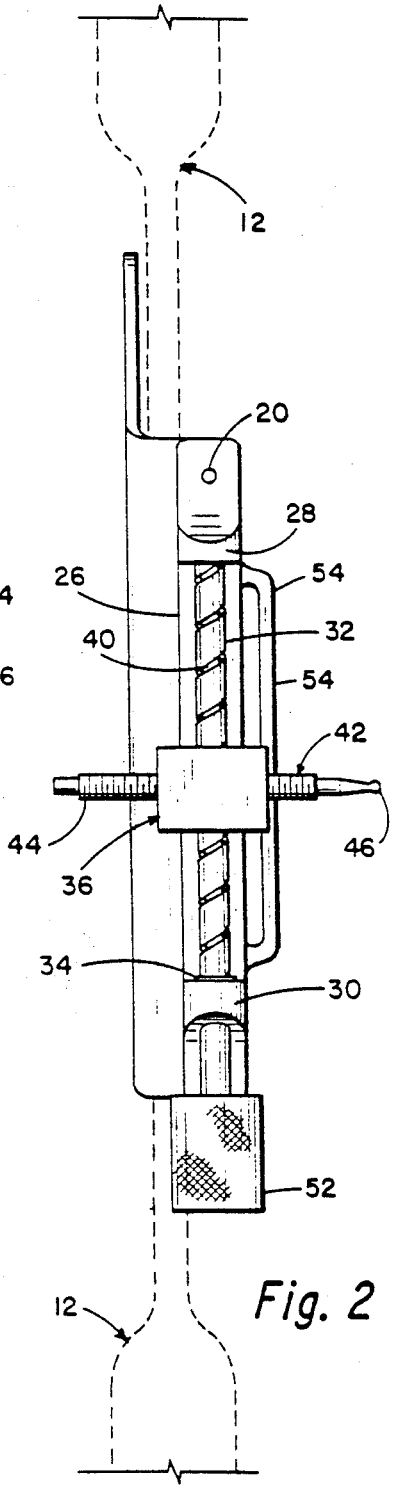
FIG. 2 is a front elevational view of the bow sight shown in FIG. 1.
Figure 4:
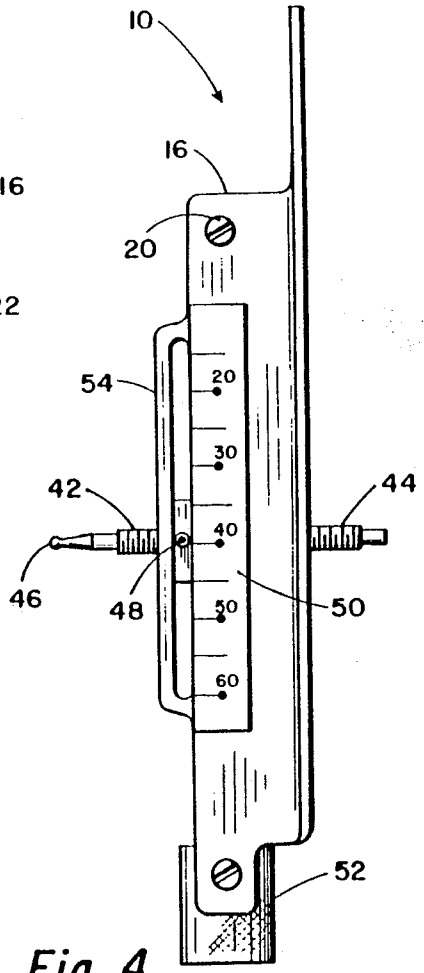
FIG. 4 is a rear elevational view of the bow sight shown in FIG. 1.

In one version of my invention, I have also provided, for ease of use, a range indicator 48, not shown in FIGS. 1 and 2, but clearly shown in FIGS. 3 and 4. Range indicator 48 is in the same horizontal plane as sight rod 44 and moves vertically with sight carriage 36 and adjacently to a range scale 50 mounted on the bracket 16 as shown in FIGS. 3 and 4.

The range scale 50 can be of several different configurations. One configuration is that shown in the Figures, another configuration is for the scale to be placed on a shoulder adjacent the juncture of the bracket 16 and the housing 14. The shoulder can be integral or removable and flat/perpendicular or angled. Further, since each person needs to be able to customize his/her own bow, the range scale 50 can be a plurality of press-on range numbers or markets that can be applied by the archer at the exact positions needed for that particular archer-bow combination.

A knurled knob 52 is provided on the lower end of the screw member 32 in a manner that the knob 52 is operable, i.e., rotatable, by a finger of the archer's hand that is holding the bow 12 so that, even while the archer is holding the bow securely in shooting position, he can adjust the sight simply and easily while keeping the sight bead 46 and range indicator 48 in his line of sight.

In FIGS. 2 and 4 I have also shown, as may be included in one form of my invention, a guard member 54 for protection of the range indicator 48, although this is not essential to the proper operation of the box sight.

Figure 7:
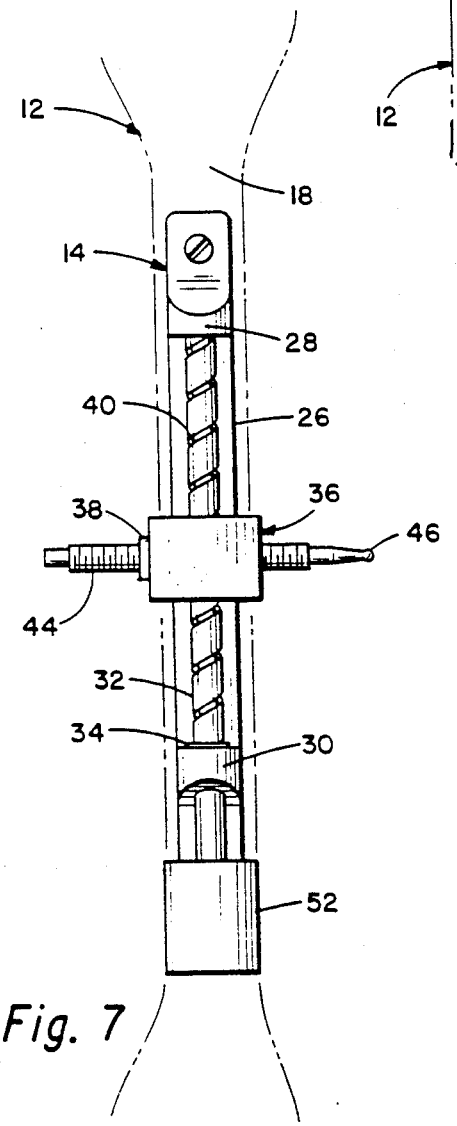
FIG. 7 is a front elevational view of a modified form of bow sight according to my invention.
Figure 8:
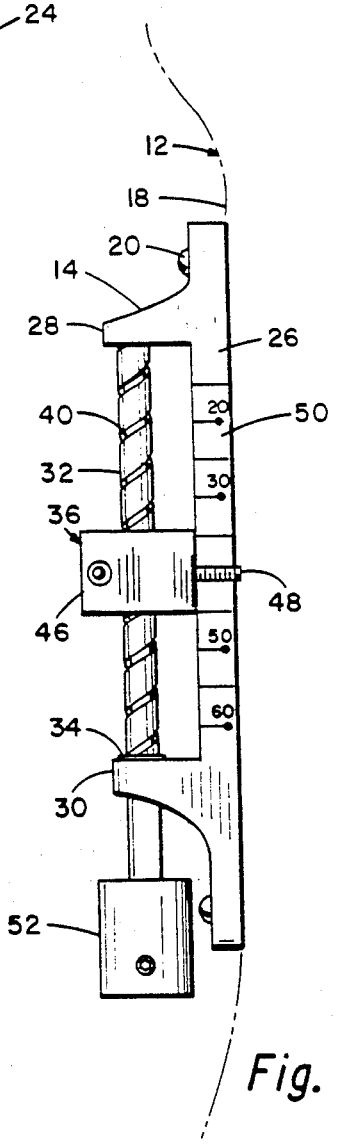
FIG. 8 is a side elevational view of the modified form of bow sight shown in FIG. 7.

In FIGS. 7 and 8 I have shown an alternative embodiment of my bow sight which does not include the mounting bracket 16, and in which the elongated housing 14 is mounted directly on the target side of the bow, and in which the range scale 50 is mounted on the side of the housing 14 adjacent the range indicator 48. For certain bows, because of the conformation of the bows, the embodiment shown in FIGS. 7 and 8 can be necessary. With this embodiment a slight side movement of the head can be necessary to determine the range in correlation with the position of the sight bead on the target. The horizontal movement again will be very slight.

I have also devised an embodiment in which I have positioned the range scale 50 at an angle of sight between the angular disposition shown in FIG. 4 and that shown in FIG. 8. That is, the angular disposition between the range scale 50 of FIGS. 4 and 8 is essentially 90 degrees. Therefore, I have contemplated a position therebetween of approximately 45 degrees from either.

Figure 9:
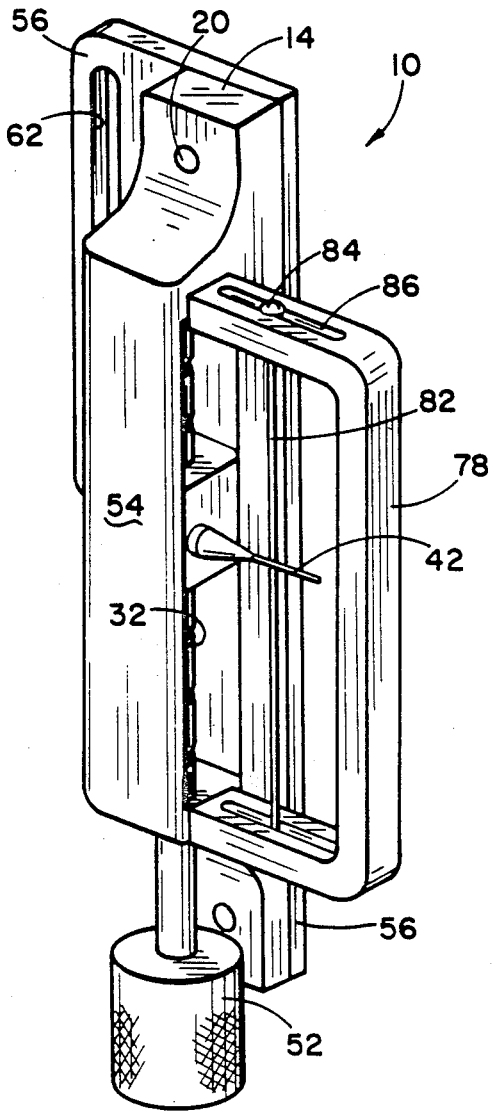
FIG. 9 is a perspective front view of an alternate embodiment of the bow sight.
Figure 10:
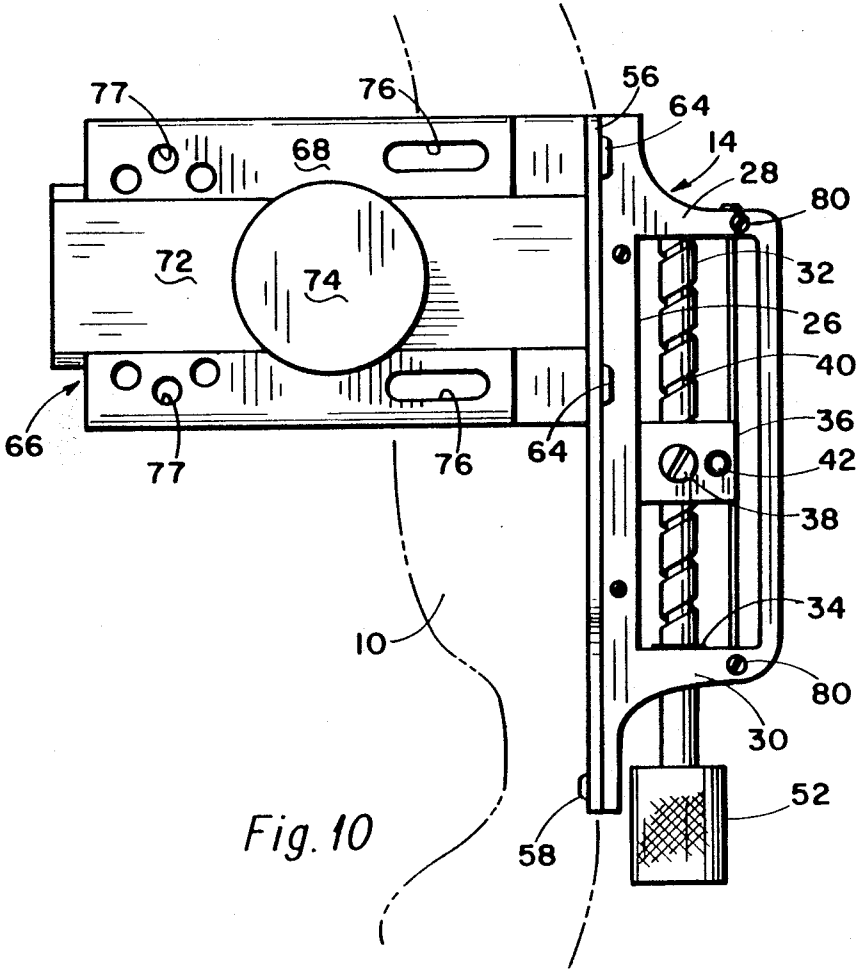
FIG. 10 is a right side elevational view of the bow sight of FIG. 9.
Figure 11:
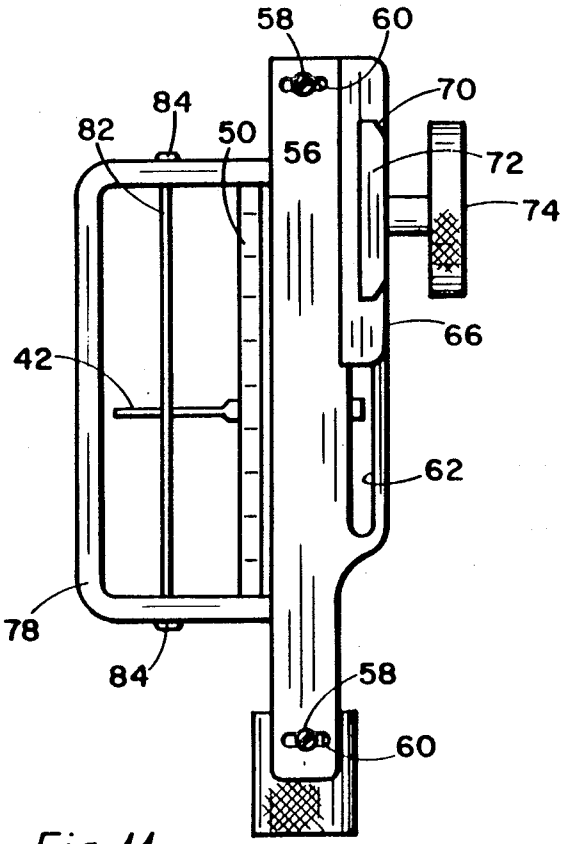
FIG. 11 is a rear elevational view of the bow sight of FIG. 9.

An alternate embodiment of the bow sight 10 is shown in FIGS. 9, 10 and 11. This bow sight 10 includes features, as discussed below, that can be used on all other embodiments of the present invention. First of all the bow sight can include an integral or removable forward guard or protection member 54 that extends forwardly from the upper and lower supports 28/30 to protect the screw member 32 from damage.

The sight housing 14 can be mounted to an intermediate bracket 56 by at least two bolts or screws 58 that pass through slots 60 in the intermediate bracket 56. The purpose of the slots 60 is to provide an adjustability from side-to-side of the bow sight 10 with respect to the bow 10, as well as a roll or lateral pitch adjustment to compensate for any irregularities in the bow 10 to ensure that the bow sight 10 is absolutely vertical.

The intermediate bracket 56 can include one or more elongated vertical slot(s) 62 to provide for vertical adjustability of the bow sight 10 to ensure that the knob 58 lies as close as possible to the center line of the bow 10 so that the knob 58 is at the position for the archer's index finger to rotate the knob 58 to thus adjust the bow sight 10.

As shown in FIGS. 10 and 11, the housing 14 is mounted by way of screws or bolts 64 to a dove-tail type bracket 66, which is well known in the art. Basically, the dove-tail bracket 66 comprises a first section 68 having an internally beveled slot 70 therein, and a second section 72 that slides within the slot 70 to provide fore/aft adjustability of the bow sight 10. The intermediate bracket 56 can be mounted to the second section 72 or formed integral therewith. A screw type knob 74 extends through a threaded bore in the second section 72 and presses against an inner surface of the slot 70 to restrain the movement of the second section 72 as is well known in the art.

The dove-tail bracket 66 can be mounted to the bow 10 by way of screws or bolts (not shown) passing through two slots 76 in the first section 68. The slots 76 provide for fore/aft adjustability of the box sight 10 but also permits radial movement or fore/aft pitch of the bow sight 10. The slots 76 are symmetrically disposed above and below the second section 72. Further, a plurality of accessory mounting bores 77 are included in the first section 68 above and below the second section 72.

It should be apparent to those skilled in the art that the present invention provides vertical, fore/aft or front-to-back, lateral or side-to-side, lateral roll or pitch, and/or front/back pitch adjustability. These adjustments can be critical to target and hunting archers.

A side extension member, bracket or frame 78 can be integral with or mounted to the sight housing 14 by way of screws or bolts 80. The frame 78 can be used to protect the sighting element 42, or can include a windage bar 82. The sighting element 42 and the windage bar 82 can be formed from wire, metal bars or opaque or translucent plastic. The windage bar 82 is mounted to the frame 78 by way of screws or bolts 84 which pass through holes or slots 86 in the upper and lower portions of the frame 78.

Since many different embodiments of this invention may be made without departing from the spirit and scope thereof, it is to be understood that the specific embodiments described in detail herein are not to be taken in a limiting sense, since the scope of the invention is best defined by the appended claims.

What is claimed is:

1. A bow sight providing yardage adjustability by movement of a finger of an archer's hand that is holding the bow in a shooting position, comprising:

an elongated sight housing, means for removable mounting of the sight housing to the bow in a position such that the bow sight can be adjusted vertically by movement of a finger of an archer's hand that is holding the bow in a shooting position, upper and lower opposed support members extending from an upper and a lower portion of the sight housing, an elongated screw member having an upper portion rotatably mounted to the upper support member and a lower end thereof extending downwardly through the lower support member, a sight carriage mounted to the screw member including means to vertically move the sight carriage as the screw member rotates, and including a horizontal sighting element extending from the sight carriage, and a knob mounted to the lower end of the screw member wherein rotation of said knob by a finger of the archer's hand that is holding the bow in a shooting position provides a single adjustability for yardage.

2. A bow sight of claim 1 wherein the bow sight is mounted in a manner to extend across a front side of the bow.

3. A bow sight of claim 1 wherein the means for removable mounting comprises a bracket having means therein to permit vertical adjustability of the slight housing.

4. A bow sight of claim 1 wherein the means for removable mounting comprises a planar bracket having a V-shaped slot therein to permit pitch adjustability of the sight housing.

5. A bow sight of claim 1 wherein the sight housing includes means therein to permit vertical adjustability with respect to the means for removable mounting.

6. A bow sight of claim 1 wherein the sight housing includes means therein to permit lateral adjustability with respect to the means for removable mounting.

7. A bow sight of claim 1 wherein the sight housing includes a protective member extending between the upper and lower support members.

8. A bow sight of claim 1 wherein the sight housing includes means therein to permit roll adjustability with respect to the bow.

9. A bow sight of claim 1 wherein the sight housing includes a side bracket extending laterally therefrom with a windage sighting member extending vertically within the side bracket.

10. A bow sight of claim 9 wherein the windage sighting member includes means for lateral adjustability with respect to the side bracket.

11. A bow sight of claim 1 wherein the means for removable mounting comprises a planar bracket having at least two spaced elongated symmetrical slots therein to permit pitch and fore/aft adjustability of the sight housing.

12. A bow sight of claim 1 and including a range scale mounted to the sight housing.

* * * * *